United States Patent [19]

Hartwall

[11] Patent Number: 4,526,124

[45] Date of Patent: Jul. 2, 1985

[54] FENDER HOLDER

[75] Inventor: John Hartwall, Söderkulla, Finland

[73] Assignee: 501 KY K. Hartwall KB, Söderkulla, Finland

[21] Appl. No.: 546,497

[22] Filed: Oct. 28, 1983

[30] Foreign Application Priority Data

Nov. 10, 1982 [FI] Finland ..... 823855

[51] Int. Cl.[3] ..... B63B 59/02

[52] U.S. Cl. ..... 114/219; 114/343; 114/364; 248/311.2

[58] Field of Search ..... 114/219, 190, 360, 218, 114/343, 364; 248/DIG. 7, 311.2, 302, 291; 211/116, 119

[56] References Cited

U.S. PATENT DOCUMENTS

| | | | |
|---|---|---|---|
| 4,014,056 | 3/1977 | Wainwright | 114/364 |
| 4,063,323 | 12/1977 | Salvarezza | 114/19 C |
| 4,290,529 | 9/1981 | Jones | 248/311.2 |
| 4,324,381 | 4/1982 | Morris | 248/311.2 |

FOREIGN PATENT DOCUMENTS 64778 11/1982 Finland .

OTHER PUBLICATIONS

Med. Marine Intl Brocure, dated as Received in the PTO 10/7/83.

*Primary Examiner*—Trygve M. Blix
*Assistant Examiner*—C. T. Bartz
*Attorney, Agent, or Firm*—Ladas & Parry

[57] ABSTRACT

The invention relates to a fender holder, which in order to reduce manufacturing costs and necessary space for storage and transportation, is possible to produce in one or some few standard types. This is possible thereby that the present fender holder is made adjustable into different angle positions and has one or several fender baskets (3) adapted for fenders (2) of a reasonable variation of sizes. Earlier known fender holders could not be adjusted into different angle positions, whereas special fender holders were required for each wanted angle or for example for the cockpit and the pushpit of a boat. The arrangement for adjusting the holder (1) in different angular positions comprises a fastening device (4) with elements (5*a*,5*b*,5*c*) for fixing the device onto a carrying point in the boat and any other element (5*d*) which is turnable within said fixing elements (5*b*,5*c*) and can be locked in wanted positions by a screw or the like. The fender baskets (3) are arranged to be fixed to the turnable element (5*d*) by the aid of coupling devices (6) which are adjustable along the element (5*d*) and fixable at wanted positions.

5 Claims, 17 Drawing Figures

FENDER HOLDER

Figure 1:
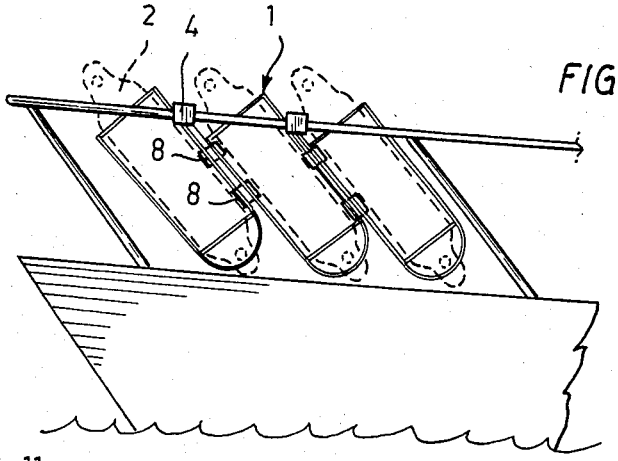

The present invention is concerned with a fender holder, which comprises at least one substantially fender-shaped basket and which holder is provided with hanging members for fastening to the railing of the boat.

Thus, the holder in accordance with the invention is used for keeping the fender on the boat deck, whereat the holder is attached to the fore and/or aft railing of the boat. By means of such a location, it is ensured that the fenders are readily within reach on landing.

There is an abundance of such fender holders on the market. However, it is a drawback of all of the prior-art fender holder solutions that the holder frames must always be manufactured as several different designs depending on the number and location of the fenders. The requirements of the boating people are, viz., highly different, so that fender holders must be manufactured, e.g., for one, two and three fenders. Moreover, it has been noticed that it is important that the fender holders can be installed at different angles on different sides of the boat. This results from the circumstance that, e.g., in the fore part of the boat, the governing line is the prow angle of the boat, i.e. the angle at which the prow of the boat cuts through the water line, whereat it is of essential importance in view of the outer appearance that the fenders placed on the railing do not diverge from this governing line to an essential extent. Thus, the fenders must be fitted at different angles in accordance with the prow angle of each boat, whereat the angle of inclination may be, e.g., 25° or 30°, etc. Under these circumstances, in the prior-art solutions, holders of its own must be manufactured for each angle of inclination. When fenders are located in the aft position of the boat, it has been noticed that it is preferable in view of the appearance to place the fender holders vertically, so that this positioning also requires holders of its own. In addition to the circumstances mentioned above, it is a drawback that it must be possible to place fender holders at both sides of the prow of the boat, whereat mirror images are required for all of the said types of different angles of inclination.

It is another drawback of the said prior-art fender holders that they are highly spacious, so that their transportation and storage become expensive.

The object of the invention is to eliminate the said drawbacks and to provide a fender holder whose manufacture, storage and transportation are advantageous and by means of which it is possible to meet all the requirements of boating people that are related to the positioning of the fenders at different sides of the boat.

The basic idea of the invention is that a basic unit is used that accommodates one fender and that is provided with fasteners to which hanging members can be attached in the desired way and at the desired angle and by means of which the necessary number of the said units can be joined together.

This is achieved by means of the solution in accordance with the invention, which is specifically characterized in that, in order to permit the hanging of a basket or baskets at different angles at different sides of a boat, each basket is provided with at least one fastening member, adjustable in the vertical direction of the basket, for detachable fastening of a hanging member and/or of an adjoining basket and that the grasping members of the hanging members, attached to the railing, have been fitted so that they can be turned and locked in accordance with the adjusted inclination of the baskets.

An advantage of the fender holder in accordance with the invention is above all its flexible possibility of use. All variations of construction that depend on the number of fenders and on their location on the boat can be formed completely on the basis of the same basic unit, whereat the number of different parts to be manufactured is reduced considerably as compared with the prior-art products. Thus, the cost of manufacture is reduced remarkably. The storage and transportation also become essentially easier, because the fender holders in accordance with the invention can be disassembled to parts that fit at least partly one inside the other, whereat the requirement of space is reduced substantially.

Figure 3A:
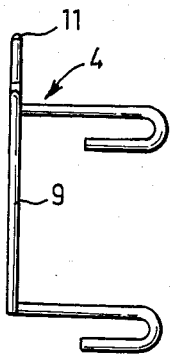
Figure 2:
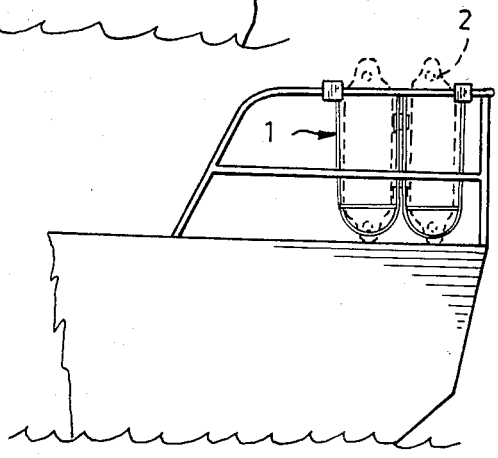
Figure 3:
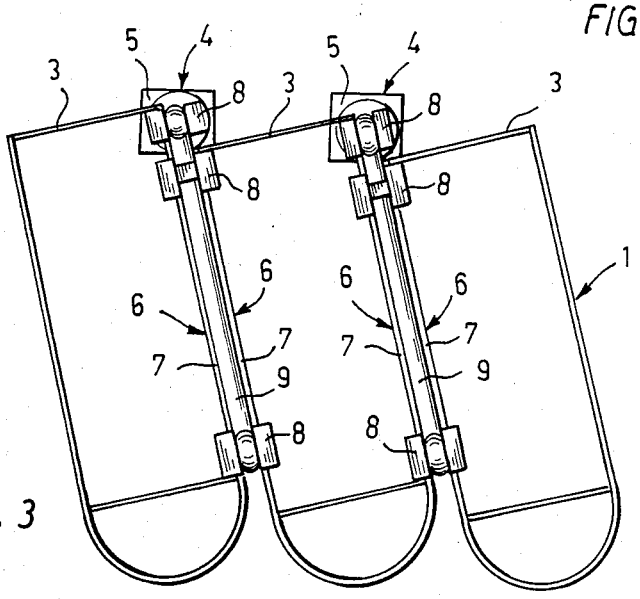
Figure 4:
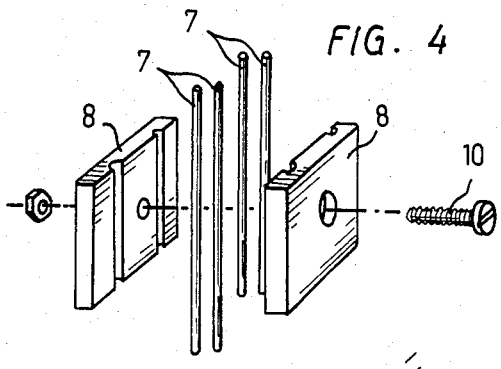
Figure 6:
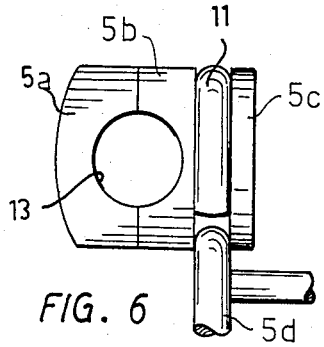
Figure 5:
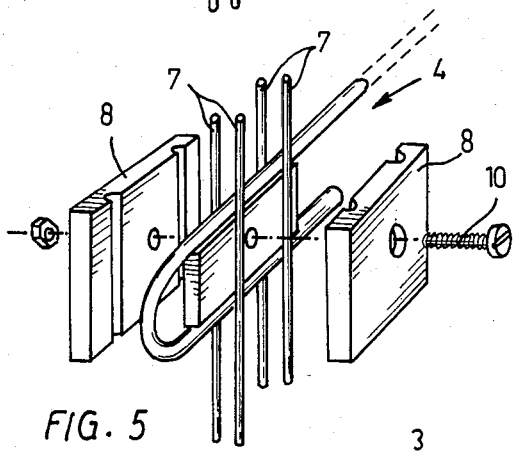
Figure 7:
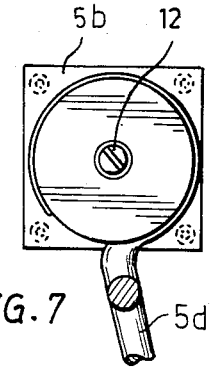
Figure 8:
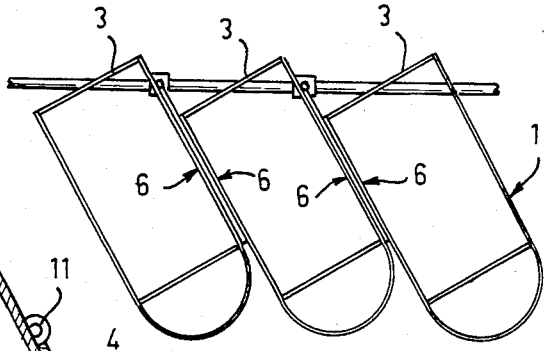
Figure 9:
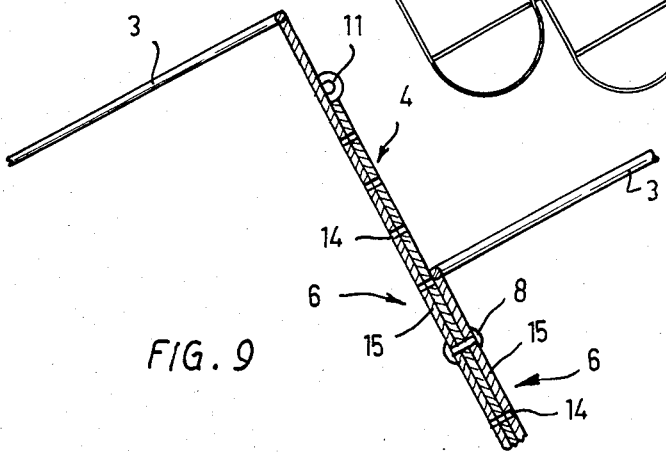
Figure 10:
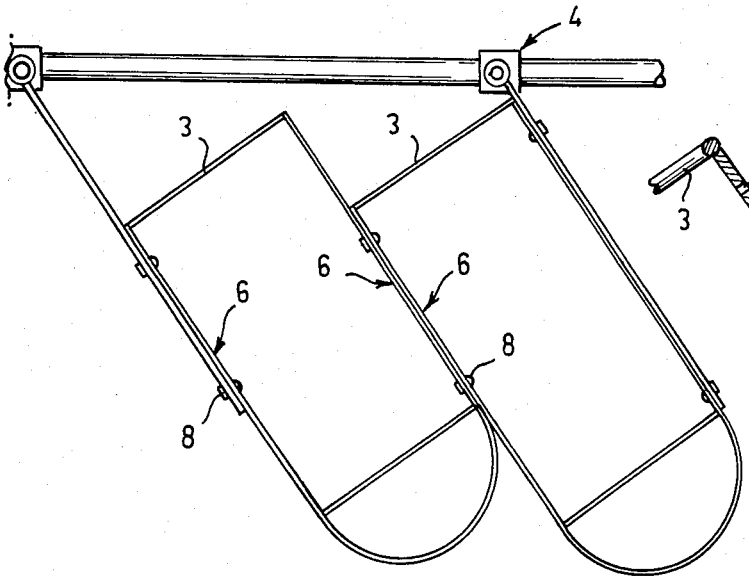
Figure 11:
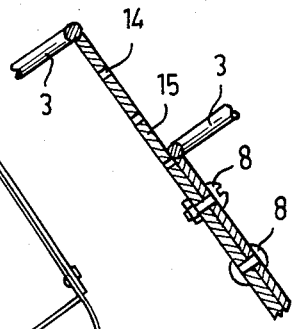
Figure 12:
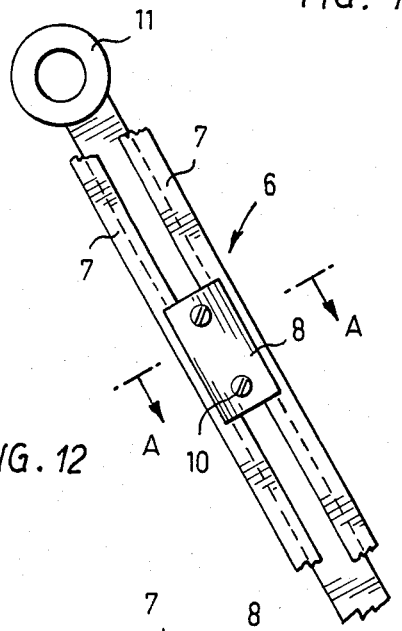
Figure 14:
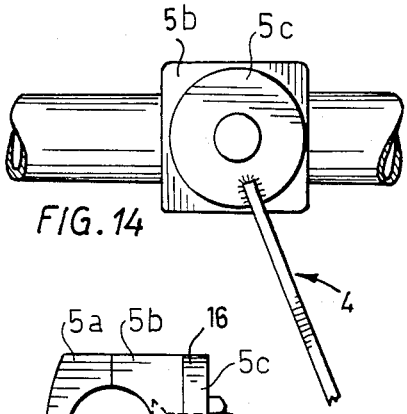
Figure 15:
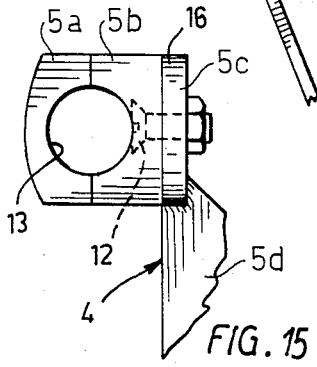
Figure 13:
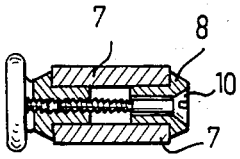
Figure 16:
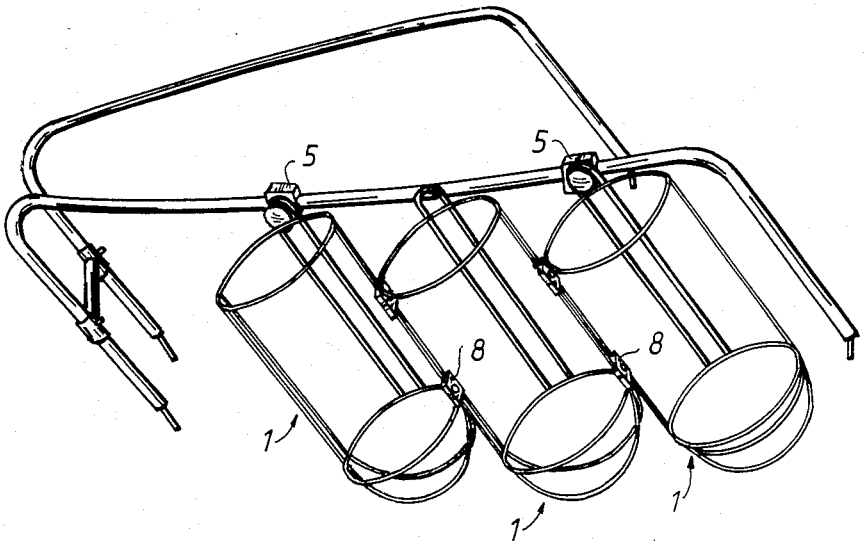

The invention will be examined in the following with the aid of the certain exemplifying embodiments shown in the drawings, whereat FIG. 1 shows the location of fenders on the left side in the fore part of the boat, FIG. 2 shows the location of fenders on the left side in the rear part of the boat, FIGS. 3 and 3*a* show a preferred embodiment of a fender holder in accordance with the invention, FIG. 4 shows a construction detail of an adjustable fastening member in the embodiment of FIG. 3, FIG. 5 shows another construction detail of the fastening member in the embodiment of FIG. 3, FIG. 6 shows the part engaging the railing in the hanging member of the embodiment of FIG. 3, as viewed in the direction of the railing, FIG. 7 shows the part of FIG. 6 as turned over 90°, FIG. 8 shows a second preferred embodiment of the invention, FIG. 9 is an enlarged view of the construction, FIG. 10 shows another application of the embodiment shown in FIG. 8, FIG. 11 is an enlarged view of the construction in accordance with FIG. 10, FIG. 12 shows one possible embodiment of the adjustable fastening member, FIG. 13 shows the construction of FIG. 12 as viewed in the direction of the section A—A, FIG. 14 shows a second embodiment of the head of the hanging member, FIG. 15 shows the construction of FIG. 14 as turned over 90°, and FIG. 16 shows a modified form of the fixing arrangement, according to which the device 5 is fixed directly on frame rods of the fender basket.

FIGS. 1 and 2 are general views of the location of the fender holders 1 at the fore and aft of the boat. In the figures, the fenders are denoted with the reference numeral 2. FIG. 1 clearly shows how the angle of inclination equals the prow angle.

FIG. 3 is a general view of a preferred embodiment of the invention. In this embodiment, the fender holder 1 is made of three baskets 3. The fender holder is, moreover, provided with hanging members 4, by means of which the holder is attached to the railing of the boat. The hanging members include a part 5 attached to the railing, which part 5 is shown in FIGS. 6 and 7 as enlarged.

For the purpose of inclining the baskets to different angles, as is shown, e.g., in FIGS. 1 and 2, each basket 3 is provided with a fastening member 6, adjustable in the vertical direction of the basket, for fastening the hanging member 4 and/or the adjoining basket 3. The number of the said adjustable fastening members 6 in each basket is at least one, but it has been noticed that it is advantageous to provide each basket diametrically with two fastening members 6, as is shown in the middle basket in the example of FIG. 3, for in such a case all of the baskets can be completely identical.

In the case of FIG. 3, the adjustable fastening member consists of a glide rail 7 and of at least one locking component 8, which is glidably fitted on the glide rail 7. The construction is shown as enlarged in FIGS. 4 and 5. In the example of FIGS. 3, 4 and 5, the glide rail 7 consists of four metal rods. This is, of course, not the only possible construction, but the glide rail can also be accomplished in many other ways. Correspondingly, the locking components 8 are only to be understood as a principle, and not as the only possible construction.

Thus, the baskets 3 are interconnected by means of the mechanism shown in FIGS. 4 and 5. It should be noticed regarding the construction that the glide rail 7 may consist of a fixed component of the basket 3. The hanging members 4 are also attached to the fender holder 1 by means of locking components 8, as is shown in FIG. 5. In the example of FIG. 3, the hanging member 4 comprises two branches (one of them is shown in FIG. 5) which are interconnected by means of a vertical part 9 running behind the baskets. In addition to this, the hanging member 4 has a grasping member 5 for attaching to the railing. The inclination of the baskets can be adjusted by opening the screws 10 in the members 8 and by shifting each basket 3 in the direction of its symmetry axis, whereat the desired angle of inclination is obtained. When the screws 10 are tightened, the baskets are locked in position. The hanging member 4 is illustrated separately in FIG. 3*a* without a grasping member.

As a result of a relative shifting of the baskets, a situation is reached in which the hanging members must be adjusted correspondingly. In the case of FIG. 3, this has been carried out so that the upper end of the hanging member 4 has been formed as a curved hook 11 (FIGS. 6 and 7). The grasping member 5 is fitted to the said hook so that, when necessary, it can be turned and locked in the desired position, e.g., by means of a screw 12. In this way, the opening 13 in the grasping member can always be positioned correctly in relation to the railing.

As regards the construction shown in FIG. 3, it should be noticed further that, when the baskets are positioned vertically (FIG. 2), the uppermost locking members 8 are omitted, whereat the upper branch of the hanging member 4 is attached to the locking members placed in the middle in FIG. 3. All the locking members are identical, so that by their means it is always possible to perform all necessary locking operations without replacing a part by another. In the example of FIG. 3, several locking members 8 are used. This construction is, however, also to be seen just as a construction of principle. It is, of course, also possible to use, e.g., one larger locking member.

In the example of FIG. 3, there are 3 baskets, but their number could also be lower or higher. Any desired number of baskets can be combined by means of the said system. It is, however, also possible to use one basket only, in which case hanging members are placed at both sides of the basket.

In the case of FIG. 3, the adjustment of the inclination is completely continuous. It is, however, also possible to accomplish the invention in a different way. An embodiment of this kind is shown in FIGS. 8 and 9. In the embodiment shown in these figures, the adjustable fastening member 6 is accomplished by means of oblong parts 15 provided with holes 14. In such a case, it is possible to use, e.g., bolts or rivets as the locking members 8. In this embodiment, the hanging member 4 is provided with holes corresponding to those in the members 6, so that the fastening takes place by fitting a hanging member 4 between the baskets or to the edge of the basket, as required. FIG. 9 also shows the arc 11 of the grasping member. Thus, the grasping member 5 may be, e.g., in accordance with FIGS. 6 and 7. According to FIGS. 6 and 7 the grasping member comprises three parts 5*a*, 5*b* and 5*c*, which are held together by a screw 12. When the parts 5*a* and 5*c* are put together they form a hole 13 adapted to grasp a rod or a similar element, for instance belonging to the cockpit of the boat. The upper curved hook 11 of the rod 5*d* is situated between the elements 5*b* and 5*c*. When the screw 12 is loosened the rod 5*d* may be turned to the desired angular position and thereafter by means of the screw 12 fixed in this position.

FIGS. 10 and 11 show an advantageous additional embodiment of the examples of FIGS. 8 and 9. The said figures show a case in which two baskets 3 are suspended at the desired angle. In such a case, the hanging members 4 are placed at the outermost edges of the baskets 3. In this construction example, the adjustment of inclination is carried out in the way in accordance with the examples of FIGS. 8 and 9. FIG. 11 shows the joint between the baskets as enlarged. In these embodiments, the oblong part may be, e.g., a steel band provided with holes, the said steel band forming a fixed part of the basket 3.

FIGS. 12 and 13 show an alternative for the adjustable fastening members 6. Under these circumstances, the glide rails 7 of FIGS. 4 and 5 can be substituted for by a so-called dovetail construction. For the sake of uniformity, the same reference numerals are used for the parts corresponding to the parts in FIGS. 4 and 5. The operation of the construction is completely equivalent to that described above in connection with FIGS. 4 and 5. The dovetail construction is seen particularly clearly in the sectional view in FIG. 13.

FIGS. 14 and 15 show a second preferred embodiment of the grasping member 5. The adjustability of the grasping member 5 has, in this embodiment, been achieved by means of a smooth face 16 formed at the upper end of the hanging member 4. The component 5 is pressed by means of a screw 12 or equivalent against this face. Under these circumstances, the opening 13 through which the railing tube or equivalent passes can always be adjusted to the correct position irrespective of the angle of inclination of the baskets. In principle, the mode of operation is a full equivalent of the embodiment shown in FIGS. 6 and 7.

The invention described above is by no means in any way strictly confined to the examples given above, but the invention may, of course, be varied within the scope of the patent claims in many other ways, too.

What I claim is:

1. A fender holder unit comprising at least two parallel fender baskets coupled together and provided with a hanging member for fastening the unit to the boat railing, said hanging member being constructed to permit the adjustment of the unit into different angles relative to the railing, the basket comprising an open framework formed by elongated rod members combined with an upper and lower ring formed member, thus forming an open basket to receive the fender therein, said baskets being coupled together by means of locking members grasping the adjacent elongated rod members of the baskets, said rods gliding along each other, when adjusting the basket angle position, and said rods being adapted to be locked by said locking members when a desired position is obtained, thereby fixing the baskets in said desired position.

2. A fender holder unit as claimed in claim 1 wherein each of said fender baskets is fitted with two adjustable fastening members, said fastening members being diametrically placed at opposite edges of each of said fender baskets.

3. A fender holder unit as claimed in claim 2 wherein each of said adjustable fastening members includes an oblong part having holes and wherein said locking members are fitted into the holes.

4. A fender holder unit as claimed in claim 1, wherein each of said hanging members includes a grasping member for attachment to the railing, the upper end of each hanging member being formed substantially as an arc of a circle on which said grasping member is fitted so as to be turned and locked in different positions.

5. A fender holder as claimed in claim 1 wherein each of said hanging members includes a grasping member for attachment to the railing, the upper end of each hanging member having a substantially plane face against which each of said grasping member tightened around the railing is placed so as to be locked in different positions.

* * * * *